United States Patent [19]

Schulz et al.

[11] 4,280,818

[45] Jul. 28, 1981

[54] NOVEL COMPOSITIONS OF MATTER AND PROCESS FOR UTILIZING SAME

[75] Inventors: Johann G. Schulz; John J. Stanulonis, both of Pittsburgh; William R. Wajert, Delmont, all of Pa.

[73] Assignee: Gulf Research & Development Company, Pittsburgh, Pa.

[21] Appl. No.: 123,921

[22] Filed: Feb. 22, 1980

[51] Int. Cl.[3] ..... C10L 1/02

[52] U.S. Cl. ..... 44/56; 208/3

[58] Field of Search ..... 208/3, 96, 265; 44/56, 44/58

[56] References Cited

U.S. PATENT DOCUMENTS

| | | | |
|---|---|---|---|
| 2,681,356 | 6/1954 | Wiese | 208/3 |
| 2,771,482 | 11/1956 | Brown, Jr. et al. | 208/3 |

*Primary Examiner*—Winston A. Douglas
*Assistant Examiner*—Y. Harris-Smith
*Attorney, Agent, or Firm*—Deane E. Keith; Forrest D. Stine; Joseph J. Carducci

[57] ABSTRACT

A process for producing a novel composition of matter which comprises oxidizing a hydrocarbon oil with aqueous nitric acid, separating from the resulting oxidation product an aqueous phase and an oxidized hydrocarbon phase as the novel composition of matter. The novel composition of matter can itself be used as a fuel or it can be a component of a novel fuel composition.

41 Claims, No Drawings

NOVEL COMPOSITIONS OF MATTER AND PROCESS FOR UTILIZING SAME

BACKGROUND OF THE INVENTION

1. Field of the Invention

This invention relates to a process for producing a novel composition of matter which comprises oxidizing a hydrocarbon oil with aqueous nitric acid, separating from the resulting oxidation product an aqueous phase and an oxidized hydrocarbon phase as the novel composition of matter. The novel composition of matter can itself be used as a fuel or it can be a component of a novel fuel composition.

2. Description of the Prior Art

Hydrocarbon oils, or selected portions thereof, have many obvious uses, for example, as fuels. Before such hydrocarbon oils can be used as fuels, they are generally subjected to many and varied treatments. We have discovered a unique process for treating hydrocarbon oils that greatly extends their utility as hydrocarbon fuels.

SUMMARY OF THE INVENTION

By "hydrocarbon oils" suitable for use in the novel process herein we mean to include atmospheric tower bottoms, vacuum tower bottoms, shale oil, tar sand bitumen, petroleum crude oils, coal liquids, etc. By "atmospheric tower bottoms" we mean to include the residue from the distillation of a crude oil at atmospheric pressure, which residue boils at a temperature above about 343° C. By "vacuum tower bottoms" we mean to include the residue from the distillation of an atmospheric tower bottoms at a pressure of 25–40 millimeters of mercury, which residue boils at a temperature above about 565° C. Typical inspections of hydrocarbon oils that can be used herein are set forth below in Table I.

ratio of about 1:0.1 to about 1:10, preferably about 1:0.3 to about 1:5.

The resultant mixture is stirred while maintaining the same at a temperature of about 5° to about 300° C., preferably about 70° to about 200° C. and a pressure of about atmospheric (ambient) to about 1500 pounds per square inch gauge (100 kPa), preferably about atmospheric to about 800 pounds per square inch gauge (55 kPa), for about 0.5 to about 15 hours, preferably about two to about six hours. Gaseous nitrogen oxides that may be formed can be removed from the reaction zone as they are formed. If desired, in order to reduce the consumption of nitric acid, the process can be carried out in the additional presence of a gaseous mixture containing an inert gas, such as nitrogen, and molecular oxygen, for example, air, wherein the partial pressure of the molecular oxygen can be in the range of about atmospheric to about 1500 pounds per square inch gauge (100 kPa), preferably about atmospheric to about 750 pounds per square inch gauge (50 kPa).

The resulting reaction product is then treated to separate the aqueous phase from the oxidized hydrocarbon phase. This can be done mechanically, if desired, for example, using a centrifuge or filter or by compressing the water therefrom. The filtrate or aqueous phase so removed can contain water-soluble constituents, for example, nitric acid, sulfuric acid, water-soluble nickel and vanadium compounds, etc. On the other hand water or water and nitric acid can be removed from the reaction mixture in any convenient manner, for example, by heating at a temperature of about 50° to about 175° C., preferably about 75° to about 150° C., and a pressure of about 10 millimeters of mercury to about atmospheric pressure, preferably about 100 millimeters of mercury to about atmospheric pressure. In the latter case only the water or water and nitric acid will be removed and if water-soluble constituents are present they will remain behind with the oxidized hydrocarbon phase. The

TABLE I

| | Atmospheric Tower Bottoms (Kuwait) | Vacuum Tower Bottoms (Kuwait) | Shale Oil (Tosco) | Tar Sand Bitumen (Wabasca) | Conventional Petroleum Crude Oil (Kuwait) | Heavy Petroleum Crude Oil (Cold Lake) | Coal Liquid (BP Range 260°–482° C.) |
|---|---|---|---|---|---|---|---|
| Gravity, °API | 15.0 | 7.4 | 20.7 | 5.7 | 31.4 | 10 | 7 |
| Viscosity, SUS at 100° F. (38° C.) | 5000 | 500,000 | 162 | 1,600,000 | 56 | 35,500 | 33.5 |
| Pour Point, °F. (°C.) | +65(18) | +95(35) | +75(−24) | +90(32) | −20(−29) | +45(7) | −4(−20) |
| Sulfur, Weight Per Cent | 4.0 | 5.2 | 0.70 | 6.11 | 2.5 | 4.55 | 0.25 |
| Metals, PPM | | | | | | | |
| Nickel | 11 | 20 | — | 32 | 8 | 72 | <1 |
| Vanadium | 54 | 100 | — | 79 | 27 | 164 | <1 |
| Carbon Residue, Rams Weight Per Cent | 9.2 | 17.7 | 3.54 | — | 3.5 | 12.0 | <1 |

The first step in the process involves subjecting the hydrocarbon oil to oxidation with aqueous nitric acid. Thus, the hydrocarbon oil itself or a mixture of said hydrocarbon oil and water, wherein the water portion thereof amounts to about 10 to about 90 weight percent, generally about 40 to about 80 weight percent, is brought into contact with aqueous nitric acid having a concentration of about five to about 90 percent, preferably about 10 to about 70 percent. What is important is that the resultant mixture containing hydrocarbon oil and nitric acid (as 100 percent nitric acid) in a weight oxidized hydrocarbon phase thus recovered is a novel composition of matter and can be used, for example, as a fuel composition in a process for generating energy in a furnace.

In a preferred embodiment, however, the oxidized hydrocarbon phase is subjected to extraction with a relatively common organic polar solvent, such as acetone, methylethylketone, cyclohexanone, methanol, ethanol, normal propanol, isopropanol, ethylacetate, tetrahydrofuran, dioxane, etc., or a combination of solvents, for example, a mixture containing an alcohol, such as methanol, ethanol or isopropanol, and a ketone, such as acetone, methylethylketone or cyclohexanone, a mixture containing an alcohol, such as methanol, ethanol or isopropanol, and water, a mixture containing a ketone, such as methylethylketone, methylisobutylketone or cyclohexanone, and water, a mixture containing a ketonic alcohol, such as acetal, diacetone alcohol, 4-hydroxy-2-butanone, 3-hydroxy-2-butanone or 4-hydroxy-2-pentanone, and an ether alcohol, such as tetrahydrofurfuryl alcohol or 2-hydroxymethyltetrahydropyron. The conditions of extraction are not critical and can be carried out over a wide range, for example, at a temperature of about 20° to about 300° C., preferably about 50° to about 175° C., and a pressure of about atmospheric to about 500 pounds per square inch gauge (34 kPa), preferably about atmospheric to about 100 pounds per square inch gauge (7 kPa). The weight ratio of extractant to oxidized hydrocarbon is not critical and can be varied over a wide range, for example, from about 6:1 to about 48:1, preferably in the range of about 12:1 to about 24:1. Whatever solid materials are left behind are, of course, insoluble in that particular polar organic solvent, or combination of solvents, used, but the important fact is that a substantial amount of the ash and metal contaminants that may have been present in the hydrocarbon oil charge will be found in the insoluble material.

The solvent can be removed from the extract in any convenient manner, for example, by heating at a temperature of about 10° to about 200° C., preferably about 25° to about 125° C., and at a pressure of about 10 millimeters of mercury to about atmospheric pressure, preferably from about 100 millimeters of mercury to about atmospheric pressure. The product so obtained, after removal of solvent therefrom, is also a new composition of matter and can be used as a fuel in a conventional manner for generating energy in a furnace or a combination engine by burning the same therein. The combustion engine that can be used herein includes internal combustion engines, such as a Diesel engine or a turbine, or an external combustion engine, such as a steam engine.

In a further preferred embodiment, the extract can be used to prepare a further novel fuel composition for use in a furnace or in a combustion engine. A mixture can be made, for example, containing the extract and a polar solvent, or a combination of polar solvents, such as defined above, particularly alcohols, such as methanol, ethanol, normal propanol or isopropanol, ketones, such as acetone, methylethylketone, or methylisobutylketone, ethers, such as diethylether, tetrahydrofuran or dioxane, and esters, such as ethylacetate or n-butylacetate, wherein the extract can amount to about five to about 80 weight percent, preferably about 20 to about 75 weight percent, of the final solution. If the above extraction is carried out using a polar solvent that is desired in the fuel mixture, obviously there is no need to separate the polar solvent from the extract. The only adjustment that need be made is to obtain the proper balance between the extract and the polar solvent desired in the final fuel.

The advantages of the above are many. The hydrocarbon oil charge used herein is non-polar. As a result of the treatment of the hydrocarbon oil, as defined herein, a product is obtained that is substantially polar and therefore substantially more soluble in a polar solvent than the original hydrocarbon oil charge. If the water soluble constituents obtained after the nitric acid treatment are removed, then a product is obtained that is reduced in ash and metal contaminants. The extraction herein with a polar solvent further enhances the attraction of the oxidized hydrocarbon oil by a further removal of ash and metal contaminants. If the original hydrocarbon oil is highly viscous, as in atmospheric or vacuum tower bottoms, the mixture of oxidized hydrocarbon oil extract and polar solvent is far more mobile and less viscous than the original hydrocarbon oil. Moreover, such mixtures make available new fuels that can incorporate therein large amounts of materials from non-petroleum sources, such as methanol or ethanol.

DESCRIPTION OF PREFERRED EMBODIMENTS

EXAMPLE I

In this example there was used an atmospheric tower bottoms obtained from a Kuwait crude, as shown in Table I, analyzing as follows in weight percent on a dry basis: 84.38 percent, carbon, 11.17 percent hydrogen, 0.28 percent nitrogen, 4.16 percent sulfur and 0.01 percent ash. The heat value (ASTM D-240) of the atmospheric tower bottoms was 18,400 BTU/pound (10,222 calories/gram). Into a one-gallon (3850 cc) stainless steel autoclave, equipped with a stirrer, thermowell and heating and cooling means, were introduced 7800 cc of distilled water and 400 grams of the atmospheric tower bottoms. While the contents were stirred, they were brought to 140° C. Over a period of one hour and 55 minutes there was gradually added 410 cc of 70 percent aqueous nitric acid. The contents of the reactor were then held at 140° C. for one hour, after which they were forced from the reactor by the reaction pressure at the reaction temperature. This material was then cooled to room temperature and the aqueous phase was removed by decantation and compression. The non-aqueous organic phase was extracted at 65° C. with six liters of methanol. After removing the solvent from the extract by rotovacing at a bath temperature of 100° C. and a pressure of 100 millimeters of mercury there was recovered 273.7 grams of oxidized hydrocarbon extract. This extract was then dissolved in methanol so that the final solution contained 65 weight percent extract and 35 weight percent methanol and had an ash content of 0.1 weight percent. The solution was judged to be easily pumpable. The heating value (ASTM D-240) of the solution was 11,320 BTU/pound (6,289 calories/gram). The insoluble residue obtained after the extraction amounted to 152.3 grams, of which 132 grams were soluble in acetone and 20.3 grams consisted essentially of ash, insoluble carbon and metal contaminants.

EXAMPLE II

Into a one gallon (3850 cc) stainless steel autoclave, equipped with a stirrer, thermowell and heating and cooling means, there were introduced 780 cc of distilled water and 400 grams of atmospheric tower bottoms similar to those used in Example I. While the contents were stirred they were brought to 140° C. Over a period of one hour and 55 minutes there was gradually added 305 cc of 70 percent aqueous nitric acid. The contents of the reactor were held at 140° C. for one hour, after which they were forced from the reactor by the reaction pressure at the reaction temperature. This material was then cooled to room temperature and the aqueous phase removed by decantation and compression. The non-aqueous organic phase was extracted at 65° C. with six liters of methanol. After removing the solvent from the extract by rotovacing at a bath temperature of 100° C. and a pressure of 100 millimeters of mercury, there was recovered 111.5 grams of oxidized hydrocarbon extract. This mixture was then dissolved in methanol so that the final solution contained 35 weight percent extract and 65 weight percent methanol and had an ash content of 0.13 weight percent. The solution was judged to be easily pumpable. The heating value (ASTM D-240) of the solution was 10,692 BTU/pound (5940 calories/gram). The insoluble residue obtained after extraction amounted to 312.5 grams, of which 285.9 grams were soluble in acetone and 26.6 grams consisted essentially of ash, insoluble carbon and metal contaminants.

EXAMPLE III

The fuel tested in Example I, containing 65 weight percent extract and 35 weight percent methanol, was further tested as a Waulkarschaw diesel engine and was found to have an experimental cetane number of 40.

Obviously, many modifications and variations of the invention, as hereinabove set forth, can be made without departing from the spirit and scope thereof, and therefore only such limitations should be imposed as are indicated in the appended claims.

We claim:

1. A process for producing a novel composition of matter which comprises oxidizing a hydrocarbon oil with aqueous nitric acid, separating from the resulting oxidation product an aqueous phase and an oxidized hydrocarbon phase as the novel composition of matter.

2. The process of claim 1 wherein said hydrocarbon oil is an atmospheric tower bottoms from the refining of petroleum oils.

3. The process of claim 1 wherein the nitric acid has a concentration of about five to about 90 percent.

4. The process of claim 1 wherein the nitric acid has a concentration of about 10 to about 70 percent.

5. The process of claim 1 wherein the weight ratio of hydrocarbon oil to nitric acid is about 1:0.1 to about 1:10.

6. The process of claim 1 wherein the weight ratio of hydrocarbon oil to nitric acid is about 1:0.3 to about 1:5.

7. The process of claim 1 wherein the oxidation is carried out at a temperature of about 5° to about 300° C. and a pressure of about atmospheric to about 1000 pounds per square inch gauge for about 0.5 to about 15 hours.

8. The process of claim 1 wherein the oxidation is carried out at a temperature of about 70° to about 200° C. and a pressure of about atmospheric to about 800 pounds per square inch gauge for about two to about six hours.

9. The process of claim 1 wherein the oxidized hydrocarbon phase is extracted with at least one organic polar solvent.

10. The process of claim 9 wherein said polar solvent is methanol.

11. The process of claim 9 wherein said polar solvent is ethanol.

12. A novel fuel composition obtained by the process of claim 1.

13. A novel fuel composition obtained by the process of claim 9.

14. A novel fuel composition comprising (1) a novel composition of matter obtained by oxidizing a hydrocarbon oil with aqueous nitric acid, separating from the resulting product an aqueous phase and an oxidized hydrocarbon phase and then extracting said oxidized hydrocarbon phase with at least one organic polar solvent to obtain an extract as the novel composition of matter and (2) an organic polar solvent.

15. The novel fuel composition of claim 14 wherein said first named polar solvent is methanol.

16. The novel fuel composition of claim 14 wherein said first named polar solvent is ethanol.

17. The novel fuel composition of claim 14 wherein said second named polar solvent is methanol.

18. The novel fuel composition of claim 14 wherein said second named polar solvent is ethanol.

19. The novel fuel composition of claim 14 wherein said hydrocarbon oil is an atmospheric tower bottoms from the refining of petroleum oils.

20. The novel fuel composition of claim 14 wherein the nitric acid has a concentration of about five to about 90 percent.

21. The novel fuel composition of claim 14 wherein the nitric acid has a concentration of about 10 to about 70 percent.

22. The novel fuel composition of claim 14 wherein the weight ratio of hydrocarbon oil to nitric acid is about 1:0.1 to about 1:10.

23. The novel fuel composition of claim 14 wherein the weight ratio of hydrocarbon oil to nitric acid is about 1:0.3 to about 1:5.

24. The novel fuel composition of claim 14 wherein the oxidation is carried out at a temperature of about 5° to about 300° C., and a pressure of about atmospheric to about 1000 pounds per square inch gauge for about 0.5 to about 15 hours.

25. The novel fuel composition of claim 14 wherein the oxidation is carried out at a temperature of about 70° to about 200° C. and a pressure of about atmospheric to about 800 pounds per square inch gauge for about two to about six hours.

26. Process for operating a furnace or combustion engine which comprises burning in said furnace or said combustion engine a novel fuel composition comprising (1) a novel composition of matter obtained by oxidizing a hydrocarbon oil with aqueous nitric acid, separating from the resulting product an aqueous phase and an oxidized hydrocarbon phase and then extracting said oxidized hydrocarbon phase with at least one organic polar solvent to obtain an extract as the novel composition of matter and (2) an organic polar solvent.

27. The process of claim 26 wherein said first named polar solvent is methanol.

28. The process of claim 26 wherein said first named polar solvent is ethanol.

29. The process of claim 26 wherein said second named polar solvent is methanol.

30. The process of claim 26 wherein said second named polar solvent is ethanol.

31. The process of claim 26 wherein said hydrocarbon oil is an atmospheric tower bottoms from the refining of petroleum oils.

32. The process of claim 26 wherein the nitric acid has a concentration of about five to about 90 percent.

33. The process of claim 26 wherein the nitric acid has a concentration of about 10 to about 70 percent.

34. The process of claim 26 wherein the weight ratio of hydrocarbon oil to nitric acid is about 1:0.1 to about 1:10.

35. The process of claim 26 wherein the weight ratio of hydrocarbon oil to nitric acid is about 1:0.3 to about 1:5.

36. The process of claim 26 wherein the oxidation is carried out at a temperature of about 5° to about 300° C. and a pressure of about atmospheric to about 1000 pounds per square inch gauge for about 0.5 to about 15 hours.

37. The process of claim 26 wherein the oxidation is carried out at a temperature of about 70° to about 200° C. and a pressure of about atmospheric to about 800 pounds per square inch gauge for about two to about six hours.

38. The process of claim 26 wherein said burning is effected in an internal combustion engine.

39. The process of claim 26 wherein said burning is effected in an external combustion engine.

40. The process of claim 26 wherein said burning is effected in a Diesel engine.

41. The process of claim 26 wherein said burning is effected in a turbine.

* * * * *